United States Patent [19]

Shiets

[11] 4,098,029

[45] Jul. 4, 1978

[54] AXLE GRINDER

[76] Inventor: Leo C. Shiets, 522 Venetian, Sandusky, Ohio 44870

[21] Appl. No.: 776,492

[22] Filed: Mar. 11, 1977

[51] Int. Cl.[2] ..... B24B 19/00

[52] U.S. Cl. ..... 51/241 S; 51/241 B; 29/401 R

[58] Field of Search ..... 51/241 S, 241 B, 241 R; 29/401 R

[56] References Cited

U.S. PATENT DOCUMENTS

| | | | |
|---|---|---|---|
| 2,675,655 | 4/1954 | Strait | 51/241 B |
| 2,818,695 | 1/1958 | Lockwood | 51/241 B |
| 3,183,636 | 5/1965 | Kelley et al. | 51/241 S |
| 3,641,716 | 2/1972 | Price | 51/241 R |

*Primary Examiner*—Harold D. Whitehead
*Assistant Examiner*—Roscoe V. Parker
*Attorney, Agent, or Firm*—Barker, Emch, Schaffer & Todd

[57] ABSTRACT

A power driven grinding machine for resurfacing the journal of trailer and vehicle axles in place on the vehicle is disclosed. The grinding machine comprises an elongate frame which is concentrically and rotatably mounted upon the vehicle axle and which includes a powered grinding wheel assembly. This assembly is translatable along the frame in a direction parallel to the vehicle axle and revolves with the frame about the axis. The grinding wheel is adjusted into longitudinal and radial registry with the bearing to be resurfaced. When power is applied, torque resulting from the frictional engagement of the rotating grinding wheel and the stationary bearing surface rotates the entire grinding machine about the axle, uniformly grinding all bearing surfaces about the periphery of the bearing.

8 Claims, 7 Drawing Figures

AXLE GRINDER

BACKGROUND OF THE INVENTION

1. FIELD OF THE INVENTION

This invention relates to an apparatus for resurfacing the bearing surfaces of truck, trailer and other motor vehicle axles. Most importantly, it is capable of resurfacing axle bearing surfaces while the axle remains on the vehicle, i.e., the axle need not be removed from the vehicle in order to rapidly and accurately resurface the bearing surfaces.

2. SUMMARY OF PRIOR ART

Motor vehicles and especially trailers utilize roller bearings to provide low friction interfaces between stationary axles and rotating wheels. These roller bearings combine low frictional coefficients with minimum maintenance and an extended service life. The roller bearing assembly itself is pressed into the wheel hub and retained by a rather tight friction fit. To facilitate the mounting of the wheel and bearing on the axle, the inner diameter of the roller bearing assembly is a somewhat loose fit upon the vehicle axle. As the bearing ages, the inner races and roller bearings become pitted, causing increased friction and thus heat generation causing the lubricant to lose its effectiveness. Seizing of the bearing components and their rotation as a single unit is a normal mode of failure. Then the entire wheel and bearing continues to rotate about the shaft and rapidly damage the bearing surface of the axle. In addition to replacing the defective roller bearing assembly, the axle surface which is secured to the truck or trailer bed must be restored or the axle replaced before the vehicle can be returned to service.

The lack of periodic inspection and lubrication often causes bearings to fail in service, sometimes catastrophically, when a truck or trailer rig is in transit in a location remote from a repair facility. Heretofore, if the axle bearing surfces are damaged, the axle must be dismounted from the vehicle, metal built up around the worn journal by welding and then the built-up portion ground down to the proper diameter and axis on a grinding lathe. The axle is then remounted upon the vehicle and the vehicle is returned to service. This procedure, of course, often results in lost time of a day or more, costing the carrier the resultant lost wages and repair expenses and delaying the delivery of the goods, etc.

An analysis of the time required to perform these repairs reveals that the majority of time is spent removing and remounting the axle. Fasteners rendered immovable by rust may have to be cut with an oxyacetylene torch and replaced. Repositioning and holding the heavy axle during remounting further contribute to difficulty and expense of this time consuming procedure. Furthermore, once the axle is removed, it must be transported to a machine shop, perhaps miles away, having grinding equipment of sufficient capacity to accommodate the axle. Likewise, if the decision is made to replace the axle, its procurement may add to the downtime of the vehicle. A portable device capable of repairing bearing surfaces destroyed by seized ball bearings which does not require the removal of the axle from the vehicle provides a substantial advantage to the trucker and the repair facility.

SUMMARY OF THE INVENTION

In a common truck axle configuration, the bearing surface to be reground is on the outermost or distal end of the axle and a second circular oil seal surface is positioned inwardly on the axle. This oil seal surface is usually not damaged and is used as a reference surface for the axle grinder of this invention.

The portable axle grinder of this invention is constructed of two generally circular end plates separated by several parallel interconnecting bars. One end plate includes a central opening surrounded by a three roller chuck assembly through which the axle is extended. The axle grinder is placed upon the axle with the roller chuck assembly in alignment with the oil seal surface of the axle and the chuck is adjusted to snugly engage it. The opposite circular end plate of the grinder includes a bearing coaxially positioned within the axle grinder on a common axis with the opening surrounded by the three roller chucks. A stub shaft extends through this bearing and is terminated with a three jaw self-aligning chuck with smooth jaws which engage the end of the axle to position the entire axle grinder concentrically about the axis of the axle.

Attached to the parallel connecting bars and movable parallel to the axis of the axle relative to them is a grinding wheel assembly powered by an electric motor. Longitudinal and radial travel adjustments control the position of the grinding wheel relative to the bearing surface to be repaired and are adjusted to bring the grinding wheel into registry with the bearing surface. The motor is energized and the frictional engagement between the grinding wheel and the bearing surface grinds the area of contact. A reaction force from this engagement rotates the entire axle grinder frame about the axle, uniformly grinding the bearing surface. Counterweights attached to the frame opposite the motor and grinding assembly balance the rotating assembly and ensure a uniform circular bearing surface. Manual measurement of the bearing diameter and longitudinal and radial adjustment of the grinding wheel positioned relative to the bearing surface accurately and expeditiously accomplishes the complete resurfacing of the axle bearing surface.

Accordingly, the elimination of the most time consuming and costly step in the resurfacing of an axle bearing, that of removing and remounting the axle, is a primary object of the instant invention.

A further object of the instant invention is to provide a portable, lightweight axle grinder that can be moved from vehicle to vehicle and job site to job site easily and conveniently.

It is an object of this invention to provide an axle grinder which is simple and rugged in order to provide extended surface life with the expenditure of only normal care routine maintenance.

It is also the object of this invention to produce an axle grinder which is easy to set up and operate in order that even a semi-skilled vehicle repair person will be capable of producing a quality bearing surface.

Other objects and advantages of the invention will be obvious to those skilled in the art from the following detailed description of a preferred embodiment thereof.

DESCRIPTION OF THE PREFERRED EMBODIMENT

Figure 1:
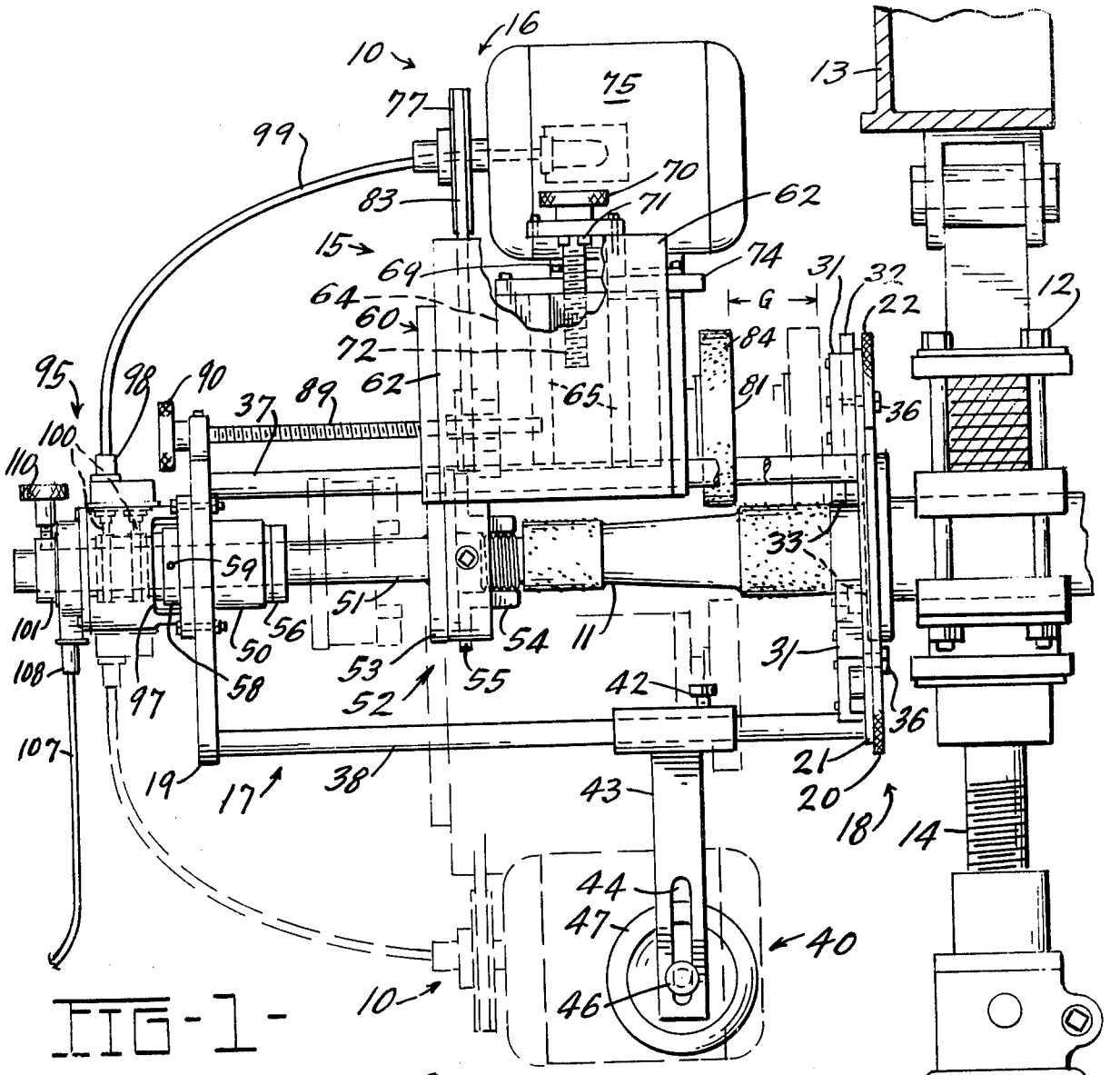
FIG. 1 is a side elevational view of the axle grinder of the instant invention in place on a typical vehicle axle.

Referring first to FIG. 1, an axle grinder of the present invention is shown generally by the reference number 10. The axle grinder 10 is mounted on an axle 11 which is connected through a suspension system 12 to a vehicle body 13. During repair of the axle 11, a jack 14 may be used to facilitate the removal and remounting of the vehicle tires and wheels which are not shown. The axle grinder 10 includes a grinding wheel assembly 15 which includes a motor assembly 16. The grinding wheel assembly 15 is mounted on two of a group of longitudinal connecting rods 17 which rigidly interconnect an inner annular plate assembly 18 and an outer annular plate assembly 19.

Figure 2:
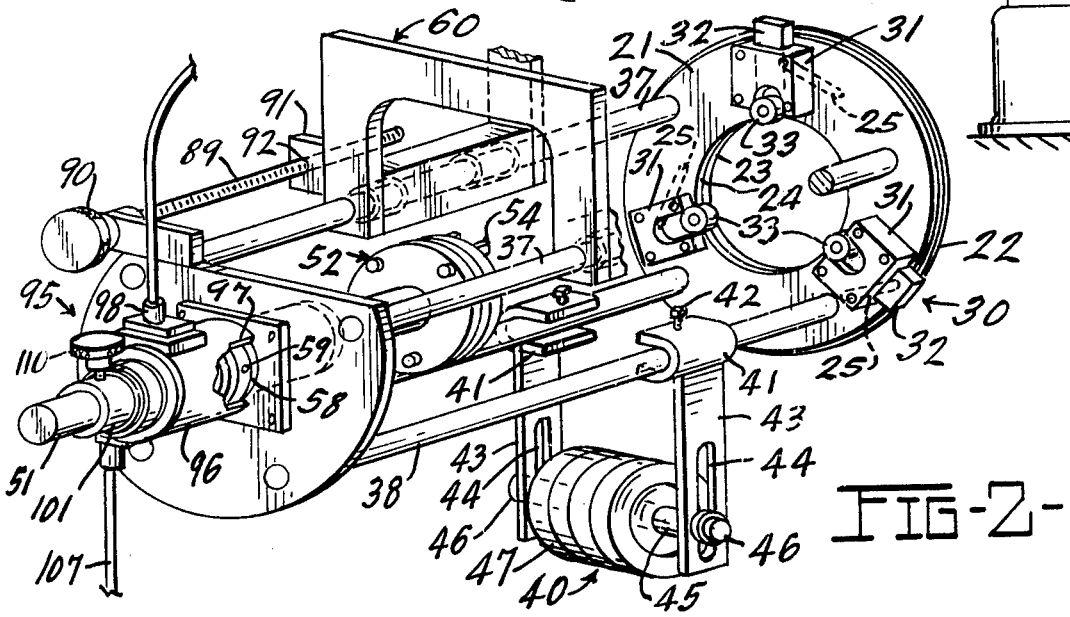
FIG. 2 is a perspective view of the axle grinder of the instant invention, with the motor and grinding wheel assembly broken away, showing the inner annular plate assembly and roller chuck assembly.
Figure 6:
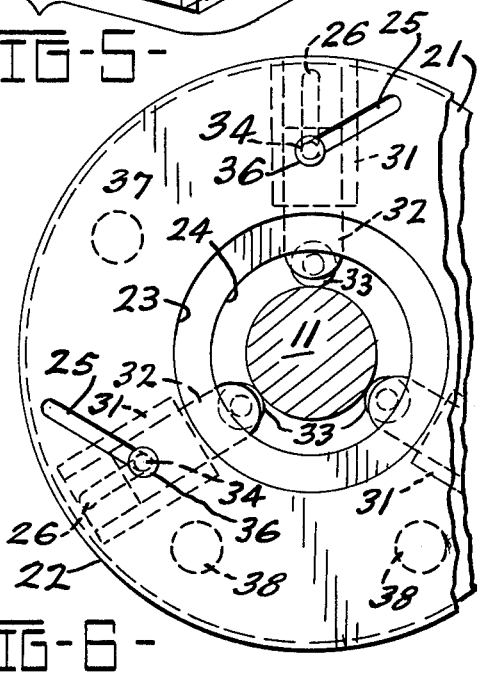
FIG. 6 is an end elevational view of the inner annular plate assembly and roller chuck assembly of the axle grinder of the present invention.

Referring now to FIGS. 2 and 6, the inner annular plate assembly 18 includes a first circular plate 20 and a second adjacent circular plate 21. The first plate 20 includes a knurled or embossed surface 22 on its outer periphery. The first plate 20 also includes a concentrically positioned circular opening 23 of a diameter sufficiently large to accommodate the largest diameter axle shaft 11 likely to be encountered on a vehicle. The first plate 20 further includes three slots 25 equally spaced about the central axis of plate 20 and each disposed at an acute angle of approximately 45° with respect to a radial line passing through the center of plate 20.

The second circular plate 21 is of smaller diameter than first circular plate 20 to facilitate the manual rotation of first plate 20 relative to second plate 21. Second plate 21 also includes a concentrically positioned circular opening 24 of a diameter substantially equal to that of opening 23. Fastening means 26 are affixed to second plate 21 which positively attach this plate to longitudinal connecting rods 17 which extend toward and are secured to the outer plate assembly 19. Inner plate 21 also contains three slots 27 which are equally spaced about the axis of inner plate 21 and which are oriented radially outwardly from the center axis of inner plate 21.

Figure 4:
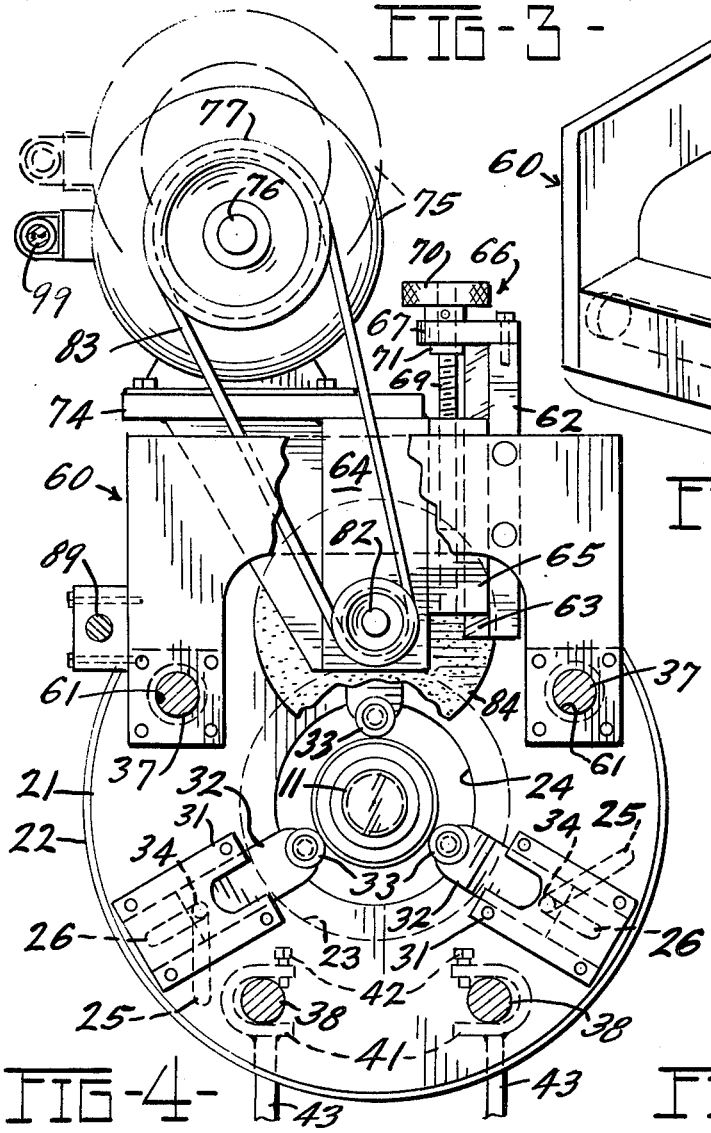
FIG. 4 is a broken away side elevational sectional view taken along line 4—4 of FIG. 3 of the axle grinder of the present invention and illustrating the parallel axial relationship of the electric motor grinding wheel axle and axle grinder frame members.

Three radial adjustment mechanisms denoted by the reference number 30 are attached to the first and second plates 20 and 21 in the following manner. These radial adjustment mechanisms 30 each includes a generally U-shaped housing 31 attached to the inner surface of the second plate 21 as is seen in FIG. 2 and FIG. 4. The generally U-shaped housings 31 are equally spaced about the central axis of the second plate 21 and are positioned to straddle the radially oriented slots 27. Positioned within each U-shaped housing 31 is a sliding bar 32 constrained to move radially within U-shaped housing 31. On each sliding bar 32, at its end directed inwardly toward axle 11, is a small roller 33. Passing through slots 26 in the first plate 20, slots 27 in the second plate 21 and secured into threaded holes 34 in each sliding bar 32 are three threaded positioning pins 35. These positioning pins 35 advance or retract the sliding bars 32 toward or away from the axle 11 in response to relative rotation between first plate 20 and second plate 21. Positioning pins 35 are threaded into the threaded holes 34 in the sliding bars 32. The positioning pins 35 include a head 36 having an Allen, Phillips or spline type configuration which facilitates the tightening of the pins 35 and thus the locking of first plate 20 and second plate 21 against one another and also fixes the position of the sliding bars 32 and the rollers 33. As viewed in FIG. 2, the upper two rods 37 are utilized as the mounting and support means for the grinding wheel assembly 15. The lower connecting rods 38 provide a mounting and support means for the counterweight assembly 40.

The counterweight assembly 40 is slidably mounted to the lower connecting rods 38 by two U-shaped members 41. U-shaped members 41 facilitate the removal, replacement and adjustment of the counterweight assembly 40 upon the lower connecting rods 38. A set screw 42 in each of the U-shaped members 41 may be tightened to positively fix the position of the counterweight assembly 40 on the lower connecting rod 38. Depending from the U-shaped members 41 are the struts 43 which each contain a vertically oriented slot 44. Extending between and mounted within slots 44 is a horizontal support 45 having tightening means 46 at each end. Mounted upon horizontal support 45 is a plurality of counterweights 47. By properly selecting the number of counterweights 47, the position of the horizontal support 45 within the slots 44 and the position of the entire counter-weight assembly 40 along the lower connecting rods 38, the mass of the grinding wheel assembly 15 may be accurately counterbalanced.

Figure 7:
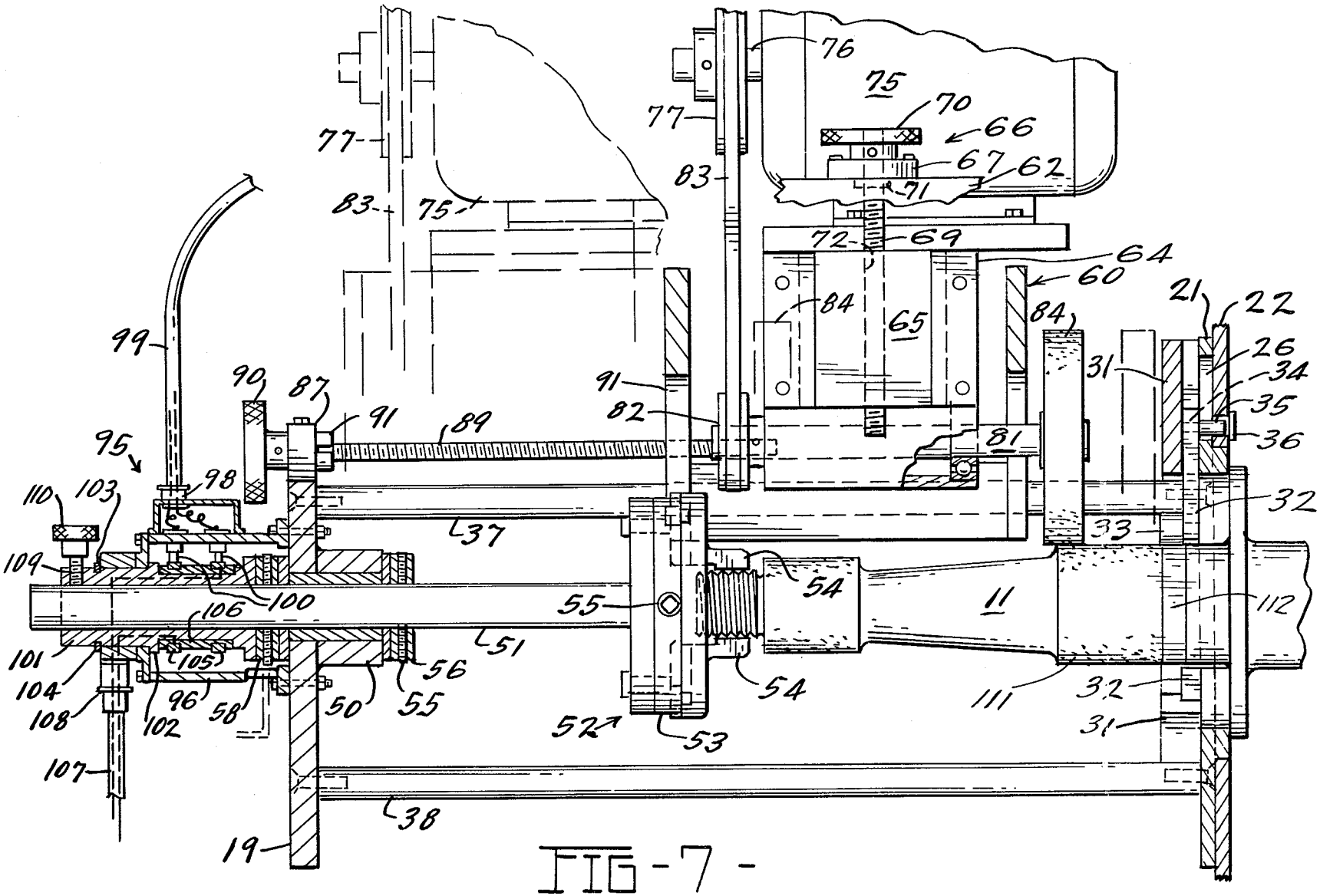
FIG. 7 is an enlarged, sectional, side elevational view of the axle grinder of the present invention illustrating the means used to attach the axle grinder to the axle and illustrating the adjustments which permit the movement of the grinding wheel position relative to the axle bearing surface.

Reference to FIGS. 1 and 2 illustrates that parallel upper and lower connecting rods 37 and 38 perpendicularly intersect and are fixed to the outer plate 19 and complete the rigid frame structure of the axle grinder 10. A bearing 50 is secured to the outer plate 19 with its axis aligned with the openings 23 and 24 in plates 20 and 21, respectively, so that the entire frame of the grinder has a reference axis of rotation defined by this bearing 50 and the center of the openings 23 and 24. As will be subsequently explained, this reference axis will be positioned to coincide with the axis of the axle 11 to be ground when the apparatus is attached to an axle as shown in the drawings. Extending through the bearing 50 and parallel to the connecting rods 37 and 38 is a stub shaft 51 which is free to move longitudinally and rotationally within the bearing 50. A three jaw chuck assembly 52 is secured to the inner end of the stub shaft 51, as seen in FIGS. 1 and 7.

The chuck assembly 52 consists of a circular disc 53 coaxially secured on the end of the stub shaft 51 and three radially movable jaws 54. The three jaws 54 are each retained to and tightened in position by adjustment screws 55. Normal set-up of the three jaw chuck assembly 52 consists of moving the shaft 51 and three jaw chuck assembly 52 adjacent the end of the axle 11 such that jaws 54 surround and engage the threaded end of the axle 11. The adjustment screws 55 are then tightened to positively and coaxially position the shaft 51 with the axle 11.

Mounted adjacent both ends of the bearing 50 are an inner collar 56 and outer collar 58. The inner collar 56 is positioned on the shaft 51 between the bearing 50 of the outer annular plate assembly 19 and three jaw chuck assembly 52. The inner collar 56 includes two set screws 57 which may be tightened to retain the inner collar 56 upon the shaft 51 and prevent the longitudinal movement of shaft 51 beyond the limit so established. The outer collar 58 is positioned on shaft 51 on the opposite side of the bearing 50 from inner collar 56. The outer collar 58 also includes two set screws 59 which may be tightened to retain the outer collar 58 upon the shaft 51 and prevent the longitudinal movement of shaft 51 beyond the limit so established. The inner collar 56 and the outer collar 58 are cooperatively used to retain the axle grinder 10 in a fixed longitudinal position relative to the shaft 51 and the axle 11 during the grinding operation as will be subsequently explained.

Referring now to FIGS. 1, 4 and particularly 5, the grinding wheel assembly 15 is slidably mounted upon the upper connecting rods 37. The grinding wheel assembly 15 includes a slidable carriage 60 having bearing passageways 61 through which upper connecting rods 37 pass to slidably mount the carriage 60 to the axle grinder 10. Oriented generally parallel to the axis of bearing passageways 61 is a plate 62 having a bevel edged tongue structure 63 extending therefrom. The carriage 60 also includes a motor mounting block 64 having a complementary beveled channel structure 65 which mates with beveled tongue 63 and permits movement of motor mounting block 64 relative to the carriage 60 along an axis perpendicular to the plane defined by the axes of upper connecting rods 37. This movement of motor mounting block 64 relative to the carriage 60 is positively adjusted by the threaded engagement of a radial adjusting device 66. This radial adjustment device 66 includes a mounting bracket 67 rigidly attached to the plate 62. The mounting bracket 67 includes an opening 68 through which a threaded stud 69 passes. The axis of opening 68 is parallel to the axis of travel of the motor mounting block 64 in the plate 62. The inner wall of opening 68 is smooth rather than threaded and provides a bearing within which threaded stud 69 may freely rotate. The threaded stud 69 also includes a thumbwheel 70 which is rigidly attached to threaded stud 69 and which facilitates the manual rotation of it. The longitudinal adjusting device 66 also includes a fastening means 71 such as a C-washed mounted upon threaded stud 69 which prevents longitudinal motion of the threaded stud 69 relative to the mounting bracket 67 and plate 62 while permitting freedom of rotational adjustment. The motor mounting block 64 includes a threaded opening 72 having threads complementary to those of threaded stud 69 and into which threaded stud 69 passes. Manual rotation of thumb-wheel 70 and therefore threaded stud 69 will urge the motor mounting block 64 and components attached to it radially toward and away from the axis of axle 11.

Figure 3:
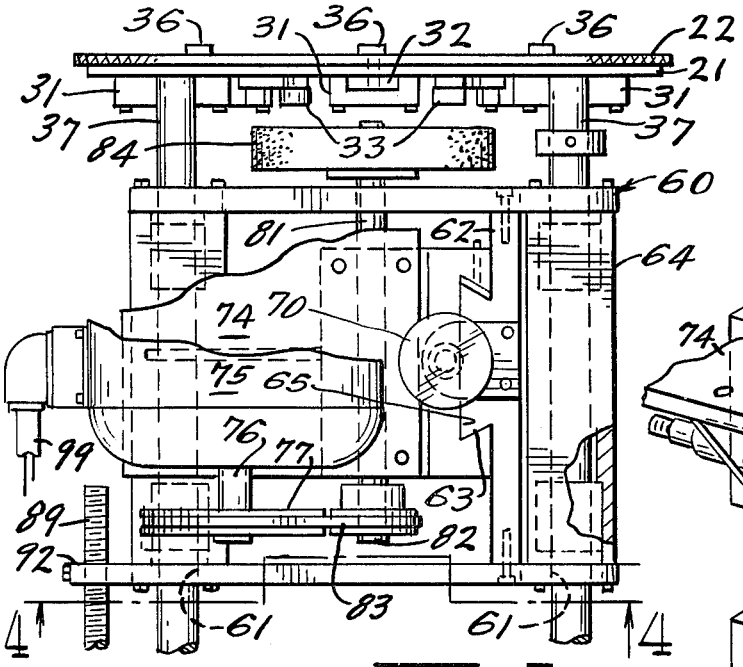
FIG. 3 is a plan view showing in detail the grinding wheel carriage assembly and inner annular plate roller chuck.

Perpendicular to the axis of travel defined by the beveled tongue 63 and channel 65 is a flat plate 74 upon which the electric motor 75 is mounted. The electric motor 75 is oriented with its power output shaft 76 parallel to the axis of the upper connecting rods 37, lower connecting rods 38 and shaft 51, as best seen in FIG. 3. The power output shaft 76 carries a V-belt pulley 77 of standard design.

The motor mounting block 74 also includes a journal bearing 80, the axis of which is parallel to that of upper connecting rods 37, lower connecting rods 38 and shaft 51 and is substantially parallel to the axis of axle 11 when the device is attached as described above. A grinding wheel shaft 81 extends through the journal bearing 80 and carries at one end a standard V-belt pulley 82. Linking V-belt pulleys 77 and 82 is a standard V-belt 83 which transfers power from power output shaft 76 of the electric motor 75 to the grinding wheel shaft 81. On the end of grinding wheel shaft 81 opposite the V-belt pulley 82 is a grinding wheel 84 which is rigidly attached to grinding wheel shaft 81 and rotates with it.

Figure 5:
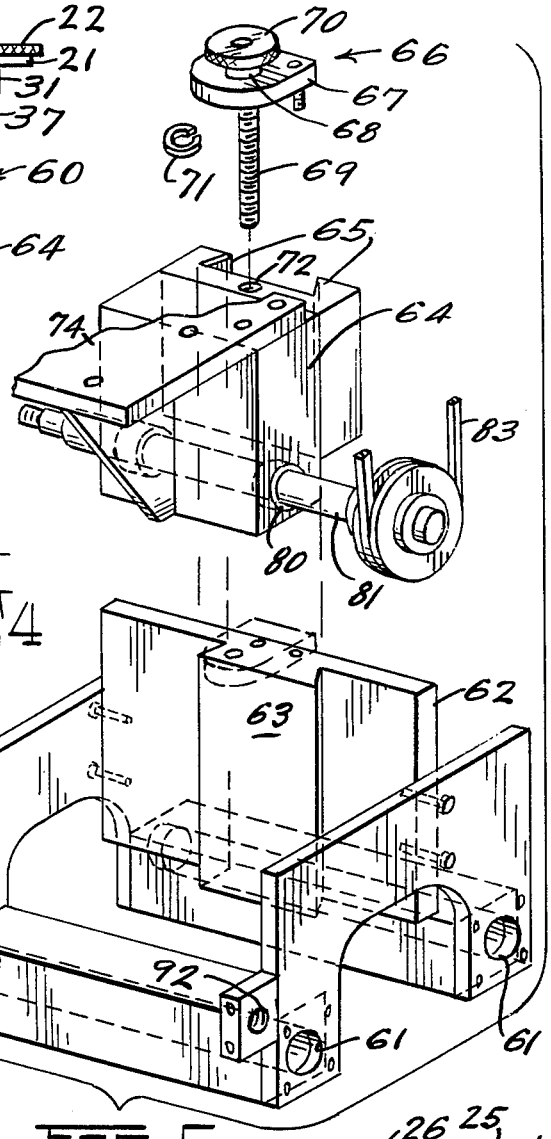
FIG. 5 is an exploded perspective view of the grinding wheel carriage assembly.

Referring now to FIGS. 2, 3 and 5, attached to the outer end plate 19 is a longitudinal adjustment device generally designated by the reference number 86 which moves the grinding wheel 84 longitudinally along the bearing surface. This longitudinal adjustment device 86 includes a mounting bracket 87 rigidly attached to the outer end plate 19. The mounting bracket 87 includes an opening 88 through which a threaded stud 89 passes. The axis of opening 88 is parallel to the axis of the upper connecting rods 37, the lower connecting rods 38 and shaft 51. The inner wall of opening 88 is smooth rather than threaded and provides a bearing within which the threaded stud 89 may freely rotate. The threaded stud 89 also includes a thumbwheel 90 which is rigidly attached to the threaded stud 89. The longitudinal adjusting device 86 also includes a fastening means 91 such as a C-washer mounted upon threaded stud 89 which prevents longitudinal motion of the threaded stud 89 relative to the mounting bracket 87 and outer end plate 19 while permitting freedom of rotational adjustment. Carriage 60 also includes a bracket 91 with a threaded opening 92 having threads complementary to those of threaded stud 89 and through which threaded stud 89 passes. Manual rotation of thumbwheel 90 and therefore threaded stud 89 will urge the carriage 60 and hence the entire grinding wheel assembly 15 longitudinally along the upper connecting rods 37.

Reference is now made to FIGS. 1 and 2 and particularly to FIG. 7. Affixed to the outer annular plate 19 is a slip ring assembly 95 which connects the electrical power from a stationary source to the rotating motor 75. This slip ring assembly 95 includes an outer shell 96 rigidly attached to the outer annular plate 19 by suitable fastening means. The outer shell 96 contains two opposed rectangular openings 97 which provide access to the set screws 59 of collar 58. Affixed to the outer surface of the outer shell 96 is an electrical fitting 98 through which wiring 99 carrying power to the electric motor 75 passes. Affixed to the inner surface of outer shell 96 are a pair of inwardly directed spring-loaded brushes 100. Each of the brushes 100 is connected to one of the power carrying conductors contained in the wiring 99 leading to the electric motor 75. Slip ring assembly 95 also includes a metallic cylindrical collar 101 mounted upon the shaft 51 and coaxial with it and the outer shell 96. The cylindrical collar 101 is positively retained within the outer shell 96 by a raised lip 102 adjacent the inner end wall of the shell 96 and by a spring C-washer 103 positioned in a channel 104 in the collar 101. Positioned on the outer surface of the cylindrical collar 101 and aligned with the inwardly directed spring-loaded brushes 100 are two metallic slip rings 105. Each metallic ring 105 is insulated from the cylindrical collar 101 by an annulus of electrically non-conducting material 106 such as bakelite or nylon. Each of the metallic rings 105 is connected to a conductor in the power cable 107 which passes through an electrical conduit fitting 108. The power cable 107 leads away from the slip ring assembly 95 and is connected to a source of electrical power which is not illustrated.

The cylindrical collar 101 also includes a radially oriented threaded opening 109 through which a thumbwheel set screw 110 passes. The thumbwheel set screw 110 has threads complementary to those of threaded opening 109 and may be tightened to positively engage collar 101, metallic slip rings 105, and power cable 107 with shaft 51. Since the shaft 51 is rigidly attached to the stationary axle 11, it remains stationary while the grinder is in operation. After the axle grinder 10 is mounted upon the axle 11, the thumbwheel set screw 110 is tightened to engage cylindrical collar 101 against shaft 51. Because shaft 51 does not rotate, the cylindrical collar 101 will also not rotate and the power cable 107 will remain stationary.

The operation of the axle grinder 10 previously described may be most clearly understood by reference to FIGS. 1 and 7. The axle 11 has a bearing surface 111 which has been damaged. Usually, this will be in the form of pitting and channeling of the bearing surface 111 and other damage due to overheating. Therefore, before the axle grinder 10 is utilized, additional metal must be added to the bearing surface 111 by welding. The bearing shown in FIG. 1 has had this additional material added, is not oversized, and is ready for resurfacing. The inner annular plate assembly 18 is placed toward the axle 11 and suspension system 12 and the shaft 11 is passed through openings 23 and 24 in outer plate 20 and inner plate 21 of inner annular plate assembly 18. The axle grinder 10 is positioned so that small rollers 33 are longitudinally alinged with the oil seal surface 112. Next, the outer plate 20 and the inner plate 21 are rotated relative to one another urging the radial adjustment mechanism 30 and more specifically the small rollers 33 into relatively tight engagement with the oil seal surface 112. Positioning pins 34 are tightened, preventing additional motion between outer plate 20 and inner plate 21 and radial travel of the small rollers 33.

Shaft 51 is then moved longitudinally toward the end of shaft 11 and the three jaw chuck 53 is positioned to engage the threaded end 113 of the axle 11. The jaws 55 of the three jaw chuck 53 are positioned such that the axes of shaft 51 and shaft 11 are coincident and the set screws 56 are tightened. In order to retain the axle grinder 10 in this longitudinal position relative to the vehicle axle 11, inner collar 56 and outer collar 58 are tightened to shaft 51 by means of their respective set screws 57 and 59. Lastly, thumbwheel 110 is tightened to fixedly engage cylinrical collar 101 with shaft 51, thereby ensuring that cylindrical collar 101 will remain stationary and that power cable 107 will not rotate with the axle grinder 10.

Next, the grinding wheel 84 is placed into registry with the bearing surface 11 to be ground. Longitudinal motion of the grinding wheel assembly 15 is accomplished by adjusting thumbwheel 90 in the appropriate direction to position the grinding wheel 84 in alignment with bearing surface 111. Adjustment of thumbwheel 70 increases or decreases the radial distance between the axes of the shaft 11 and grinding wheel shaft 81 and therefore adjusts the depth of cut and, ultimately, the diameter to which the grinding wheel 84 will grind the bearing surface 111. Thumbwheel adjustments 70 and 90 should therefore be made in light of current machine shop practice and desired results and the depth of cut and speed of longitudinal movement along the bearing surface will be apparent to an operator skilled in the art of grinding or metal removal. The counterweight assembly 40 should be positioned opposite the grinding wheel assembly 15 and the set screws 42 tightened to maintain the position of counterweight assembly 40 upon the lower connecting rods 36. Adjustment of the horizontal support 45 of the counterweight assembly 40 and removal or additional of counterweights 47 may also be made as experience and conditions dictate.

The bearing surface 111 is now ready to be ground. Electric current is supplied to power cable 107 and is delivered to the electric motor 75 through the slip ring assembly 95. As the surface of the wheel 84 engages the bearing surface 111, reaction forces generated by friction between grinding wheel 84 and the bearing surface 111 will rotate the counterbalanced axle grinder 10 about the axis of the axle 11 to evenly grind all faces of bearing surface 111 longitudinally aligned with the grinding wheel 84. As the rotating mechanism continues to resolve, it is longitudinally translated over the bearing surface by adjustment of the thumbwheel 90 so that the entire cylindrical surface is resurfaced. The grinding action may be stopped at any time by the removal of electric power so that measurements of the bearing diameter 111 and adjustments to the thumbwheels 70 and 90 may then be made. The grinding operation, diameter checks and adjustments of grinding wheel position are continued until the bearing surface 111 is of the desired diameter and finish. Removal of the axle grinder 10 from the shaft 11 is easily accomplished by reversing the previously delineated steps.

Various changes may be made to the above-described preferred embodiment which will be apparent to those skilled in the art without departing from the scope and spirit of the invention hereof.

I claim:

1. A device for grinding a cylindrical wheel bearing surface on a truck axle to desired radius and alignment which bearing surface has been built up to an oversized radius, said device comprising, in combination, an elongate hollow frame having an internal reference axis extending between an inner and an outer end, chuck means associated with said outer end and coincident said reference axis for receiving and securing said axle within said frame and at least three radially translatable roller means disposed about said inner end for positioning said frame relative to said axle with said reference axis of said frame generally coincident with the axis of said axle, said roller means oriented for rotation about axes parallel to said reference axis and movable into engagement with the surface of said axle, a grinding wheel driven by a motor about a wheel shaft, means for positioning said wheel shaft parallel to said reference axis of said frame and spaced therefrom, said shaft axis being movable in a rotary path about said reference axis, means for moving said grinding wheel parallel to its said wheel to thereby translate such wheel parallel to its axis over the bearing surface to be ground, and means for moving said wheel shaft in a radial direction toward or away from said reference axis whereby said oversized bearing surfaces may be ground to desired radius and alignment by moving said wheel parallel to its wheel shaft over the axial length of said bearing surface while said wheel is driven on its shaft which rotates about said reference axis.

2. An apparatus for grinding a bearing surface on an axle including, in combination, a frame having a reference axis and comprising first and second spaced apart end plate assemblies each defining an opening coaxial with said reference axis, and a plurality of support members interconnecting said first and second end plate assemblies, said opening in said first end plate assembly defining a journal bearing, a stub shaft positioned within said journal bearing and gripping means affixed to the end of said stub shaft within said frame for gripping the end of such axle, said second end plate assembly having radially translatable roller means for engaging the oil seal surface of such axle and cooperating with said chuck means to align said reference axis with the axis of such axle, means associated with said frame for supporting a driven surfacing wheel on a wheel axis parallel to and spaced from said reference axis, said wheel axis being freely revolvable in a circular path about said reference axis, and adjustable with respect to the distance therebetween, and means associated with said surfacing wheel to translate said wheel longitudinally along its said wheel axis throughout the axial length of such bearing surface to be ground;

whereby, when said apparatus is secured to such axle with said frame reference axis aligned with the axis of such axle, said frame reference axis defines the axis of the resurfaced bearing to be ground and, when said driven surfacing wheel is adjusted such that it will bear against said bearing surface to be ground, the driven rotary motion of said wheel will cause said wheel to revolve about said reference axis and said axle and to grind all faces thereof and whereby the longitudinal movement of said wheel translating along the length of such bearing surface will effect the grinding thereof throughout its length.

3. The apparatus of claim 2 wherein said gripping means on said outer plate comprises a plurality of adjustable jaws movable toward or away from said reference axis.

4. The apparatus of claim 2 wherein the axial distance between said gripping means and said second end plate assembly of said frame is variable whereby the positions on such axle to which said plates are gripped or secured may be varied.

5. The apparatus of claim 2 wherein said driven surfacing wheel has a shaft journalled for rotation on an axis parallel to said reference axis and said wheel is movable along its shaft axis between said first and second end plate assemblies.

6. The apparatus of claim 5 wherein said surfacing wheel shaft is journalled in a slide member carried by said frame between said end plate assemblies and wherein said slide member is movable along the axis of said wheel by a threaded adjustment rod secured relative to said slide member and said outer plate.

7. The apparatus of claim 2, wherein said roller means comprises a plurality of rollers oriented for rotation about axes parallel to said reference axis and adjustably mounted for radial translation with respect to said reference axis whereby said plurality of rollers may be adjusted to accommodate various diameters of such axle surfaces and locked to maintain coincidence of said reference axis and the axis of such axle in the plane of said second end plate assembly.

8. A method of grinding a cylindrical wheel bearing surface on a stationary axle comprising the steps of establishing an axis extending through the axle and cylindrical bearing surface to be ground, mounting upon said axle a rotary grinding device having a fixed frame with a reference axis supporting a chuck journalled at one end of said frame coincident with said reference axis, a plurality of radially adjustable rollers at the other end of said frame having axes parallel to said reference axis, and a driven grinding wheel which rotates about said reference axis by securing said chuck to an end of said axle and positioning said rollers against the periphery of said axle, with the reference axis of said frame placed coincident with said established axle axis, moving said grinding device in contact with said wheel bearing surface, applying power to said rotary grinding device such that engagement of said wheel with said bearing surface causes said rotary grinding device to resolve about said reference axis to grind about the periphery of said bearing surface, and longitudinally translating said rotary grinding device parallel to said axle axis to grind said cylindrical bearing surface.

* * * * *

UNITED STATES PATENT OFFICE

CERTIFICATE OF CORRECTION

Patent No. 4,098,029 Dated July 4, 1978

Inventor(s) Leo C. Shiets

It is certified that error appears in the above-identified patent and that said Letters Patent are hereby corrected as shown below:

Claim 1, Column 9, Line 2, after "wheel" insert — shaft --.

Column 5, Line 55, "C-washed" should be -- C-washer --.

Column 6, Line 57, after "electrical" insert -- conduit --.

Column 7, Line 36, "not" should be -- now --.

Column 7, Line 61, "cylinrical" should be -- cylindrical --.

Signed and Sealed this

Ninth Day of January 1979

[SEAL]

*Attest:*

RUTH C. MASON
*Attesting Officer*

DONALD W. BANNER
*Commissioner of Patents and Trademarks*